US010535485B2

(12) United States Patent
Ando et al.

(10) Patent No.: US 10,535,485 B2
(45) Date of Patent: Jan. 14, 2020

(54) FUSE MANUFACTURING METHOD AND FUSE

(71) Applicant: Pacific Engineering Corporation, Ogaki-Shi (JP)

(72) Inventors: Mitsuru Ando, Ogaki (JP); Yoshinobu Miyata, Ogaki (JP)

(73) Assignee: PACIFIC ENGINEERING CORPORATION, Ogaki-Shi (JP)

( * ) Notice: Subject to any disclaimer, the term of this patent is extended or adjusted under 35 U.S.C. 154(b) by 0 days.

(21) Appl. No.: 15/568,063

(22) PCT Filed: Sep. 9, 2016

(86) PCT No.: PCT/JP2016/076544

§ 371 (c)(1),
(2) Date: Oct. 20, 2017

(87) PCT Pub. No.: WO2017/110160

PCT Pub. Date: Jun. 29, 2017

(65) Prior Publication Data

US 2018/0122606 A1 May 3, 2018

(30) Foreign Application Priority Data

Dec. 22, 2015 (JP) ..... 2015-249663

(51) Int. Cl.
*H01H 69/02* (2006.01)
*H01H 85/08* (2006.01)
(Continued)

(52) U.S. Cl.
CPC ..... *H01H 69/02* (2013.01); *H01H 85/08* (2013.01); *H01H 85/143* (2013.01); *H01H 85/165* (2013.01)

(58) Field of Classification Search
CPC .... H01H 69/02; H01H 85/143; H01H 85/165; H01H 85/175; H01H 85/157;
(Continued)

(56) References Cited

U.S. PATENT DOCUMENTS 4,570,147 A * 2/1986 Ebi ..... H01H 85/0417 337/166
4,611,192 A * 9/1986 Arora ..... H01H 85/055 337/163
(Continued)

FOREIGN PATENT DOCUMENTS

JP 11-10428 Y1 7/1936
JP 46-6457 Y1 3/1971
(Continued)

OTHER PUBLICATIONS

"Blade type terminal part of all hermetically sealed tubular fuse to be fixed by using semicircular dividing washer", Mar. 6, 1971, Entire Document (Translation of JP466457). (Year: 1971).*
(Continued)

*Primary Examiner* — Jayprakash N Gandhi
*Assistant Examiner* — Stephen S Sul
(74) *Attorney, Agent, or Firm* — Shumaker, Loop & Kendrick, LLP

(57) ABSTRACT

The present invention provides a fuse manufacturing method and a fuse that facilitate an assembling work of the fuse. Disclosed is a method of manufacturing a fuse including a fuse element including a pair of terminal portions and a fusing portion between the terminal portions, a casing for accommodating the fuse element, and a cap for closing openings at both ends of the casing. In this fuse manufacturing method, the fuse element is positioned in the casing such that the terminal portion of the fuse element protrudes from the opening of the casing, and a holding plate for
(Continued)

holding the fuse element is inserted between a peripheral portion of the opening of the casing and an abutment piece provided at the terminal portion of the fuse element. Further, in this method, the opening of the casing is closed by the cap so as to cover the holding plate.

2 Claims, 14 Drawing Sheets

(51) Int. Cl.
*H01H 85/143* (2006.01)
*H01H 85/165* (2006.01)

(58) Field of Classification Search
CPC .. H01H 85/08; H01H 85/045; H01H 85/0458; H01H 85/0454; H01H 85/15
USPC ..... 29/623, 825, 878, 745, 756; 337/228, 337/246, 251, 252
See application file for complete search history.

(56) References Cited

U.S. PATENT DOCUMENTS 5,055,817 A * 10/1991 O'Shields ..... H01H 85/08 337/161
5,345,210 A * 9/1994 Swensen ..... H01H 85/055 337/163
6,194,989 B1 * 2/2001 Douglass ..... H01H 85/10 337/228
2010/0102920 A1 * 4/2010 Stanek ..... H01H 85/0013 337/186
2015/0348731 A1 * 12/2015 Douglass ..... H01H 69/02 337/198
2016/0141138 A1 * 5/2016 Schlaak ..... H01H 85/185 337/231

FOREIGN PATENT DOCUMENTS

JP S466457 * 3/1971
JP 49-44706 B1 11/1974
JP 49-447066 B 11/1974
JP 2004-127902 A 4/2004
JP 2010-15715 A 1/2010
JP 2012-43573 A 9/2013

OTHER PUBLICATIONS

Shimizu Akihiko, "Fuse", Jan. 21, 2010, Taiheiyo Seiko KK, Entire Document (Translation of JP2010015715, of record, cited in IDS including Original Copy). (Year: 2010).*
International Search Report for PCT/JP2016/076544 (and corresponding English translation) dated Nov. 8, 2016 (SS pages).

* cited by examiner

FUSE MANUFACTURING METHOD AND FUSE

TECHNICAL FIELD AND BACKGROUND

The present invention relates to a fuse to be used mainly for, for example, an electric circuit for an automobile, and relates particularly to a fuse manufacturing method, in which a fuse element is stretched and held in a casing, and a fuse.

In the prior art, fuses have been used to protect an electric circuit mounted in an automobile or the like and various electric components connected to the electric circuit. Specifically, when unintended overcurrent flows in the electric circuit, a fusing portion of a fuse element embedded in the fuse fuses due to heat generated by overcurrent to protect so as not to allow excess current to flow through the various electric components.

There are various kinds of fuses depending on the application, and, for example, the fuse described in Patent Literature 1 for protection from a relatively large overcurrent has been known.

This fuse is of a type which stretches and holds a fuse element in a tubular casing. More specifically, the fuse is provided with a tubular cover body (casing), a fusible body (fuse element) stretched in the cover body, and two fusible body holders sandwiching both ends of the fusible body therebetween at both ends of the cover body. The two fusible body holders abut against peripheral portions of openings on both sides of the cover body while sandwiching the both ends of the fusible body therebetween. Consequently, the fusible body (fuse element) is stretched inside the cover body and held so as not to be displaced.

However, in the fuse of Patent Literature 1, the process of accommodating the fuse element in the cover and sandwiching the end of the fuse element, protruding from the opening of the cover, between the two fusible body holders from above and below the fuse element must be performed, so that an assembling work becomes complicated.

CITATIONS LIST

Patent Literatures

Patent Literature 1: JP-A-2012-43573

SUMMARY

In view of the above, the present invention provides a fuse manufacturing method and a fuse that facilitate an assembling work of the fuse.

A fuse manufacturing method according to the present invention is a method of manufacturing a fuse including a fuse element including a pair of terminal portions and a fusing portion between the terminal portions, a casing for accommodating the fuse element, and a cap for closing openings at both ends of the casing. In this fuse manufacturing method, the fuse element is positioned in the casing such that the terminal portion of the fuse element protrudes from the opening of the easing, and a holding plate for holding the fuse element is inserted between a peripheral portion of the opening of the casing and an abutment piece provided at the terminal portion of the fuse element. Further, in this method, the opening of the casing is closed by the cap so as to cover the holding plate.

According to the above feature, since the holding plate is inserted between the abutment piece of the fuse element and the peripheral portion of the opening of the casing, an assembling work becomes easier as compared with the prior art.

Further, in the fuse manufacturing method according to the present invention, the fuse element is integrally formed by processing a single metal plate, and the terminal portion of the fuse element is formed by folding and superimposing ends of the single metal plate.

According to the above feature, since the terminal portion of the fuse element is formed by folding and superimposing portions of the single metal plate, even if the terminal portion has the same thickness as the conventional one, a resistance value of the terminal portion is small as compared with the prior art.

Furthermore, in the fuse manufacturing method according to the present invention, the abutment piece is formed by folding a portion of the terminal portion such that the portion of the terminal portion rises from the terminal portion.

According to the above feature, since the abutment piece is formed by folding a portion of the terminal portion, there is no need to attach a separate abutment piece to the terminal portion, and contact resistance due to the attachment of the abutment piece does not occur.

A fuse according to the present invention includes a fuse element including a pair of terminal portions and a fusing portion between the terminal portions, a casing for accommodating the fuse element, and a cap for closing openings at both ends of the casing. In this fuse, the fuse element is positioned in the casing such that the terminal portion of the fuse element protrudes from the opening of the casing, and a holding plate for holding the fuse element is inserted between a peripheral portion of the opening of the casing and an abutment piece provided at the terminal portion of the fuse element. Further, in this fuse, the cap closes the opening of the casing so as to cover the holding plate.

According to the above feature, since the holding plate is inserted between the abutment piece of the fuse element and the peripheral portion of the opening of the casing, an assembling work becomes easier as compared with the prior art.

Further, in the fuse according to the present invention, the fuse element is formed of a single metal plate, and the terminal portion of the fuse element is formed by folding and superimposing ends of the single metal plate.

According to the above feature, since the terminal portion of the fuse element is formed by folding and superimposing portions of the single metal plate, even if the terminal portion has the same thickness as the conventional one, a resistance value of the terminal portion is small as compared with the prior art.

Furthermore, in the fuse according to the present invention, the abutment piece is formed such that a portion of the terminal portion rises from the terminal portion.

According to the above feature, since the abutment piece is a portion of the terminal portion, there is no need to attach a separate abutment piece to the terminal portion, and contact resistance due to the attachment of the abutment piece does not occur.

As described above, according to the fuse manufacturing method and the fuse of the present invention, an assembling work of the fuse is facilitated.

Figure 1A:
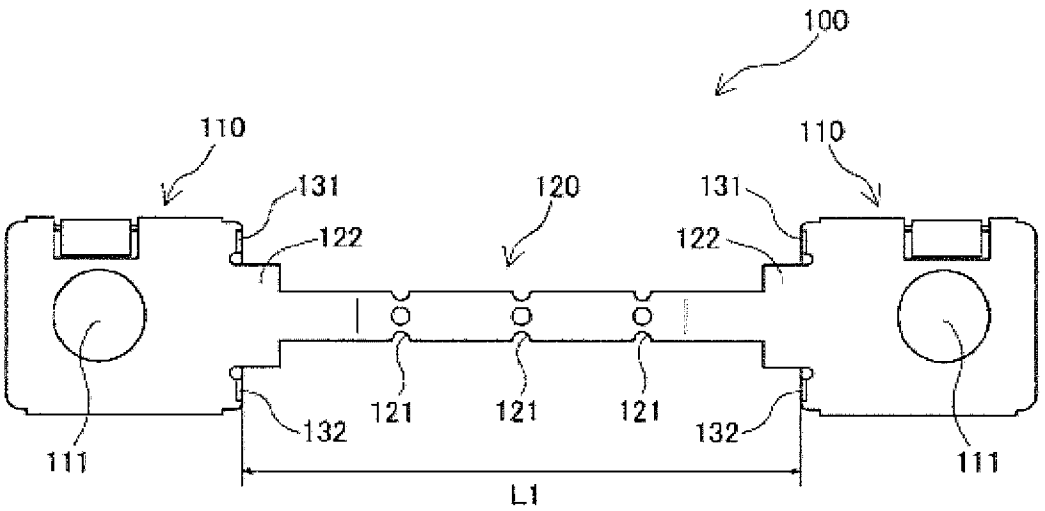
FIG. 1(*a*) is a plan view of a fuse element of a fuse according to Embodiment 1 of the present invention, FIG.
Figure 1B:
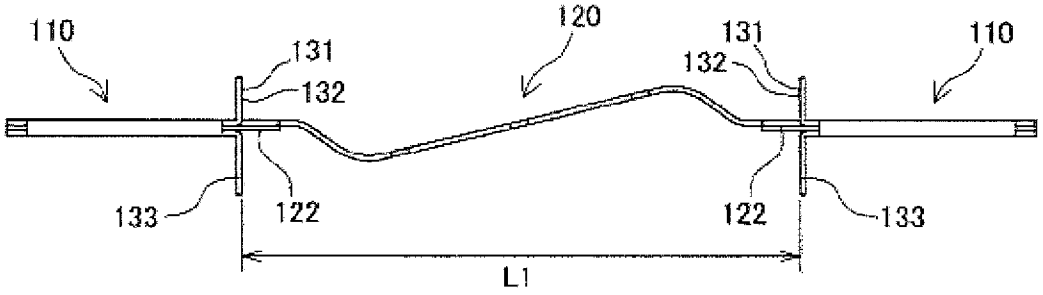
Figure 1C:
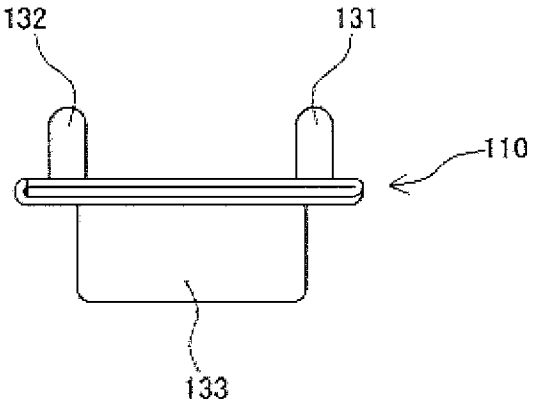
Figure 2A:
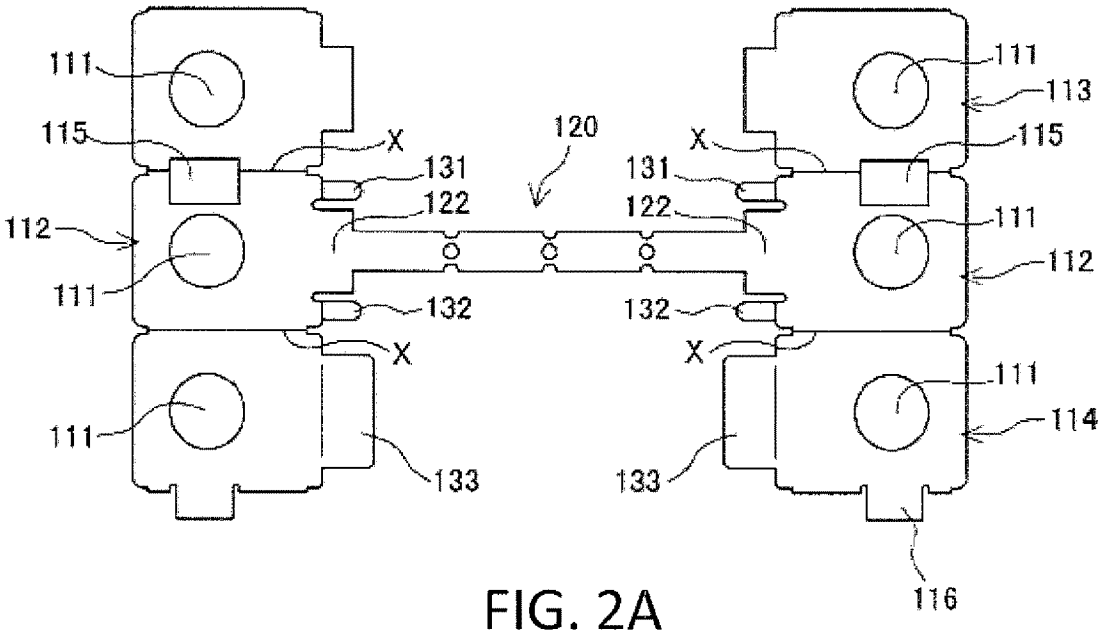
Figure 2B:
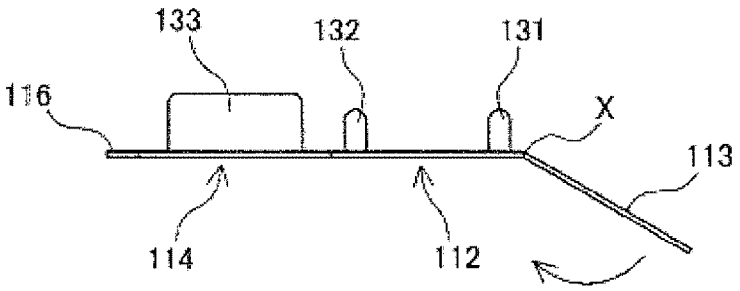
Figure 2C:
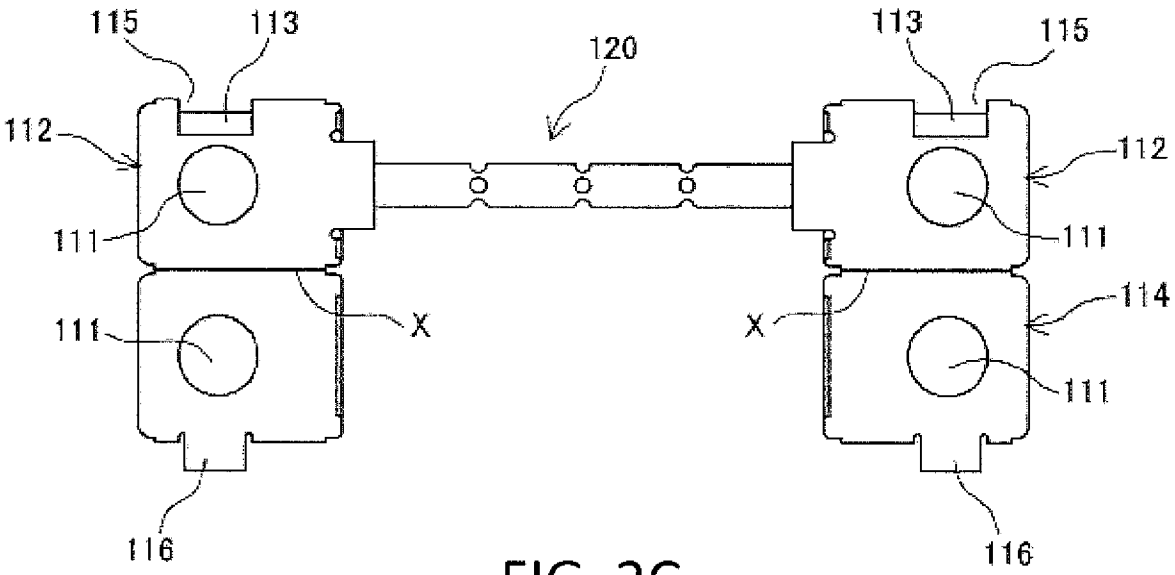
Figure 2D:
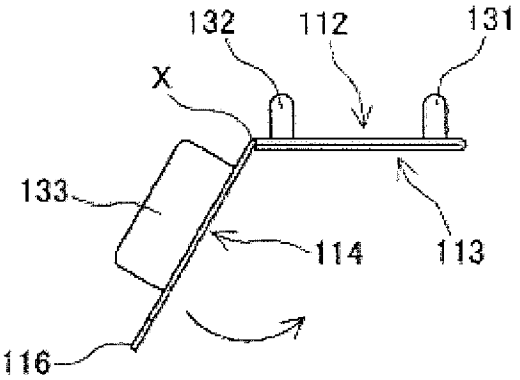

1(*b*) is a front view of the fuse element, and FIG. 1(*c*) is a side view of the fuse element.

FIGS. 2(*a*) to 2(*d*) are views showing a process of manufacturing the fuse element of the fuse according to Embodiment 1 of the present invention, FIG. 2(*a*) is a plan view of the fuse element, FIG. 2(*b*) is a side view of the fuse element, FIG. 2(*c*) is a plan view of the fuse element, and FIG. 2(*d*) is a side view of the fuse element.

Figure 3A:
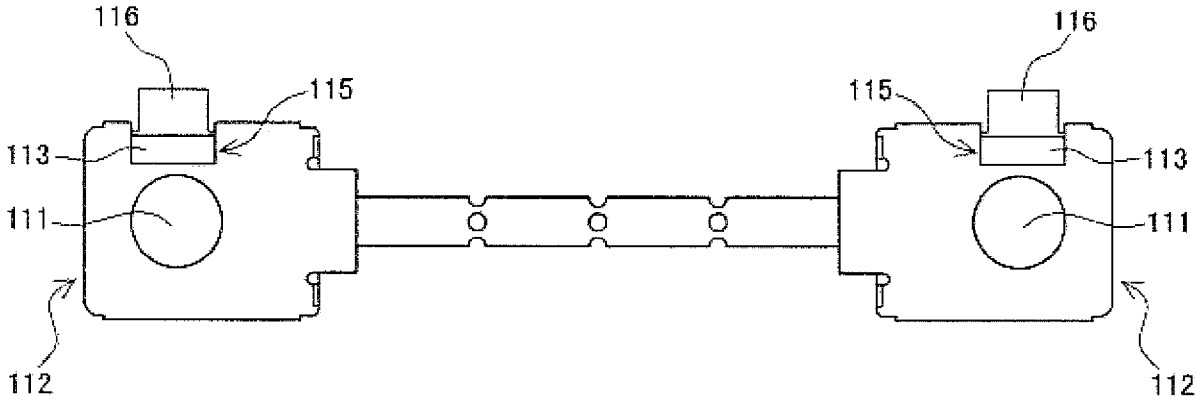
Figure 3B:
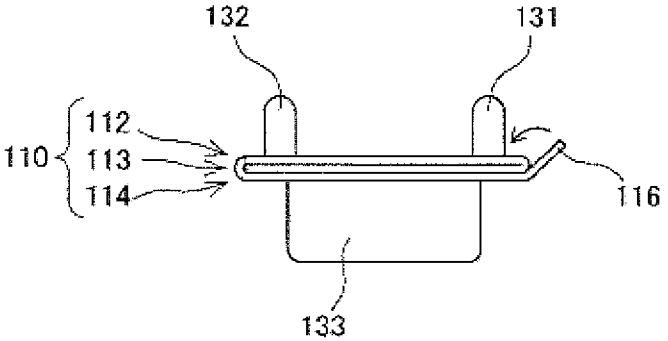
Figure 3C:
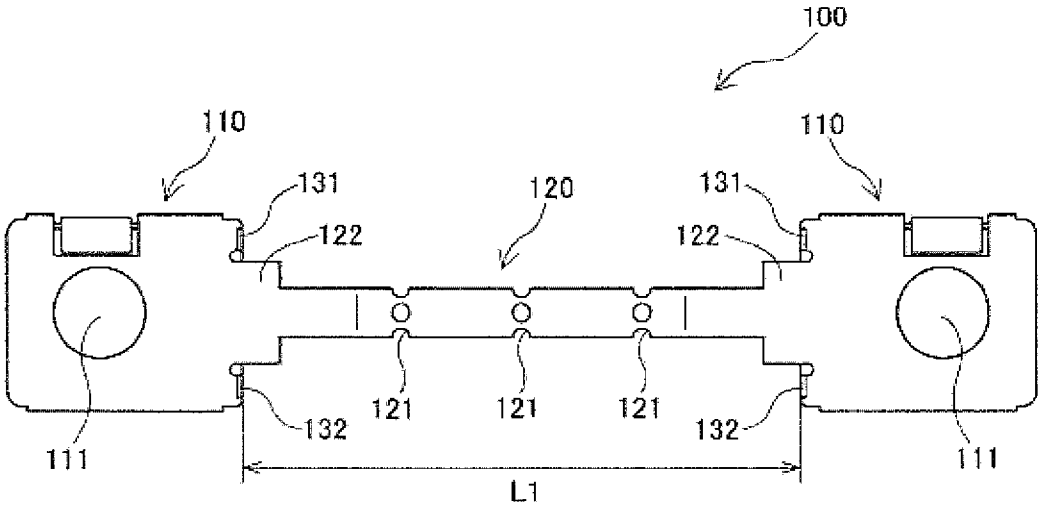
Figure 4B:
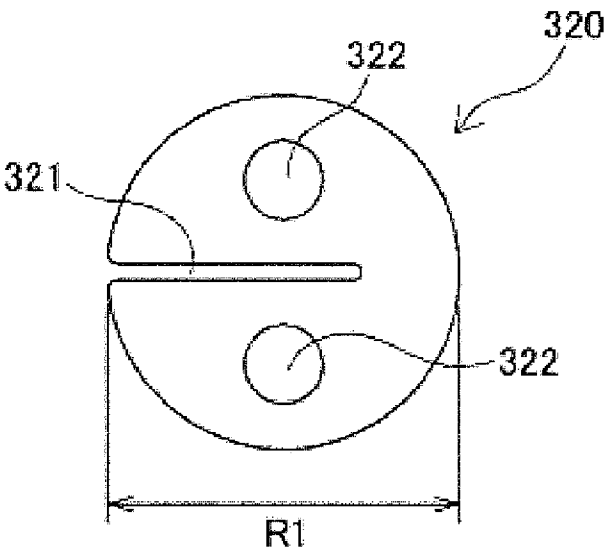
Figure 4A:
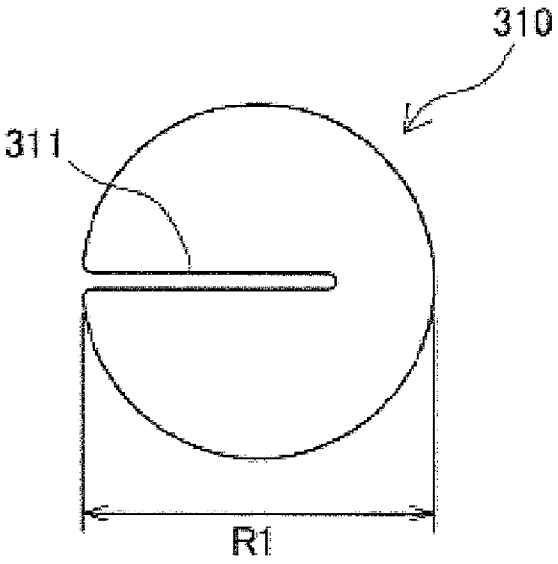
Figure 4D:
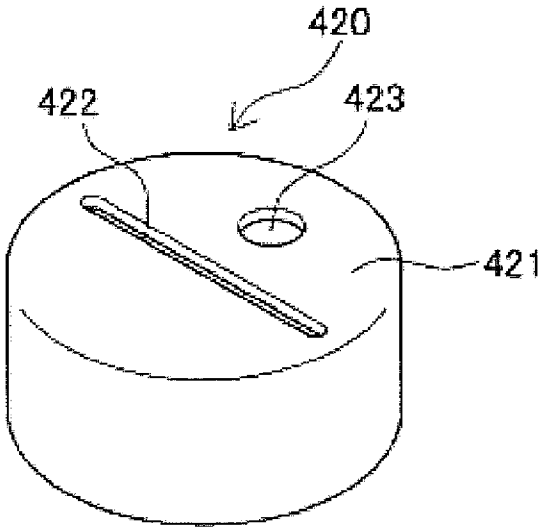
Figure 4C:
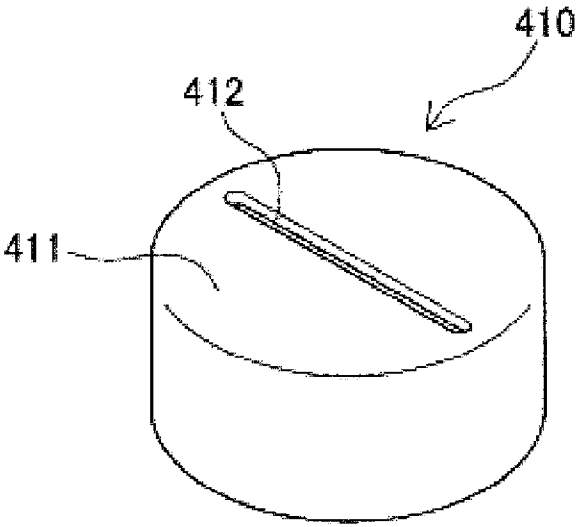

FIGS. 3(*a*) to 3(*c*) are views showing the process of manufacturing the fuse element of the fuse according to Embodiment 1 of the present invention, FIG. 3(*a*) is a plan view of the fuse element, FIG. 3(*b*) is a side view of the fuse element, and FIG. 3(*c*) is a plan view of the fuse element.

FIGS. 4(*a*) and 4(*b*) are plan views of a holding plate of the fuse according to Embodiment 1 of the present invention, and FIGS. 4(*c*) and 4(*d*) are perspective views of a cap of the fuse according to Embodiment 1 of the present invention.

Figure 5A:
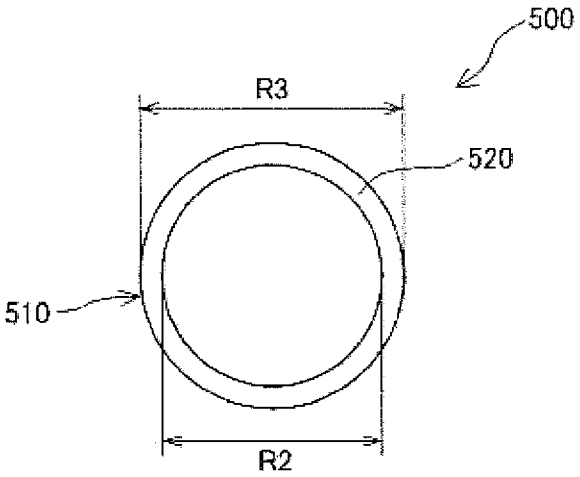
Figure 5B:
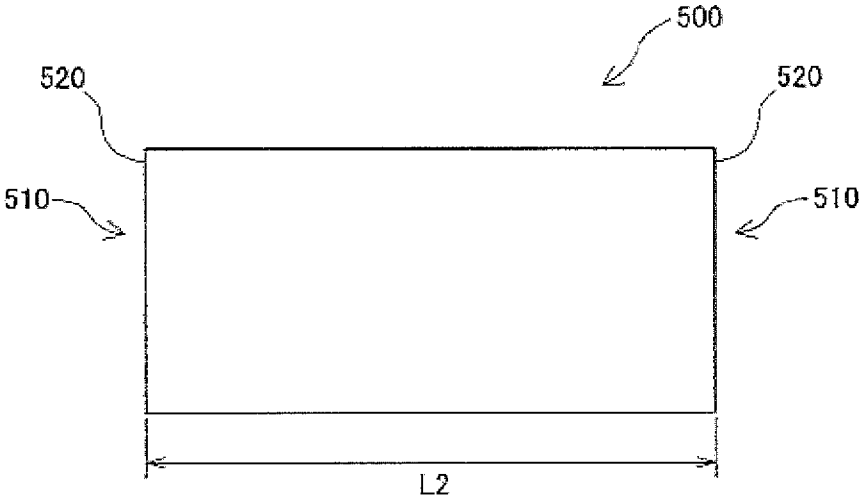

FIG. 5(*a*) is a side view of a casing of the fuse according to Embodiment 1 of the present invention, and FIG. 5(*b*) is a plan view of the casing.

Figure 6A:
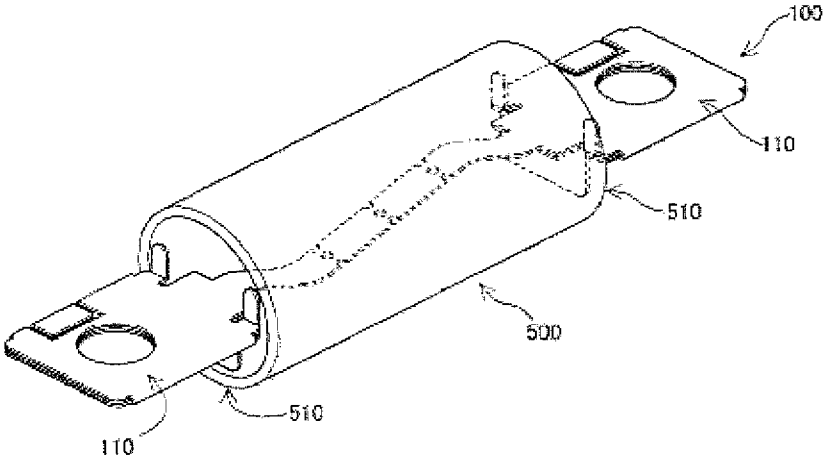
Figure 6B:
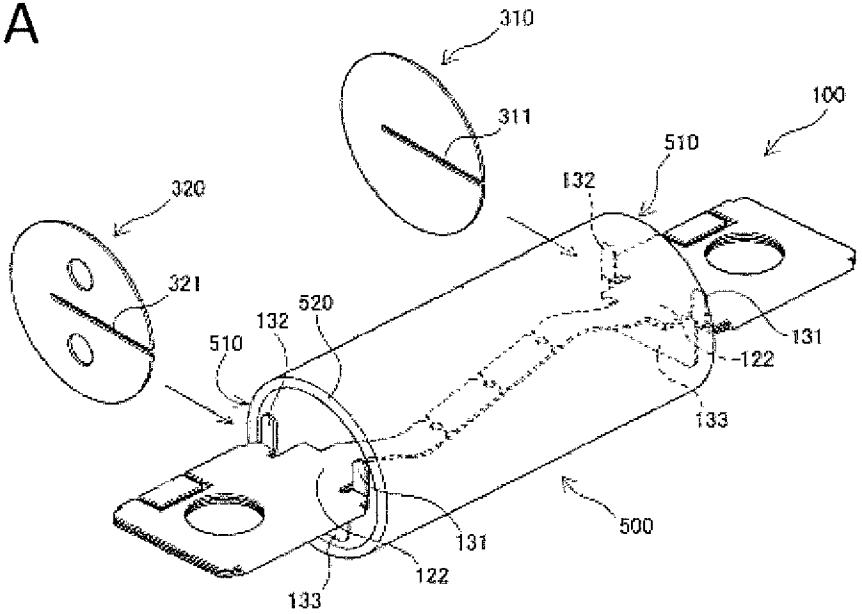
Figure 6C:
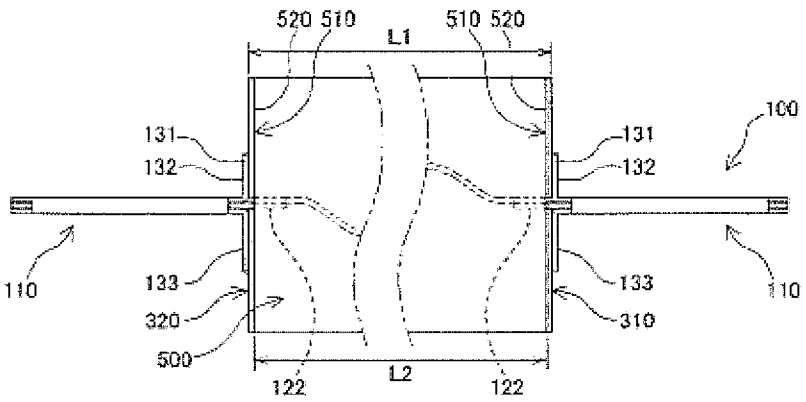

FIGS. 6(*a*) and 6(*b*) are perspective views showing a fuse manufacturing method according to Embodiment 1 of the present invention, and FIG. 6(*c*) is a front view showing the fuse manufacturing method and is an enlarged view of both ends.

Figure 7A:
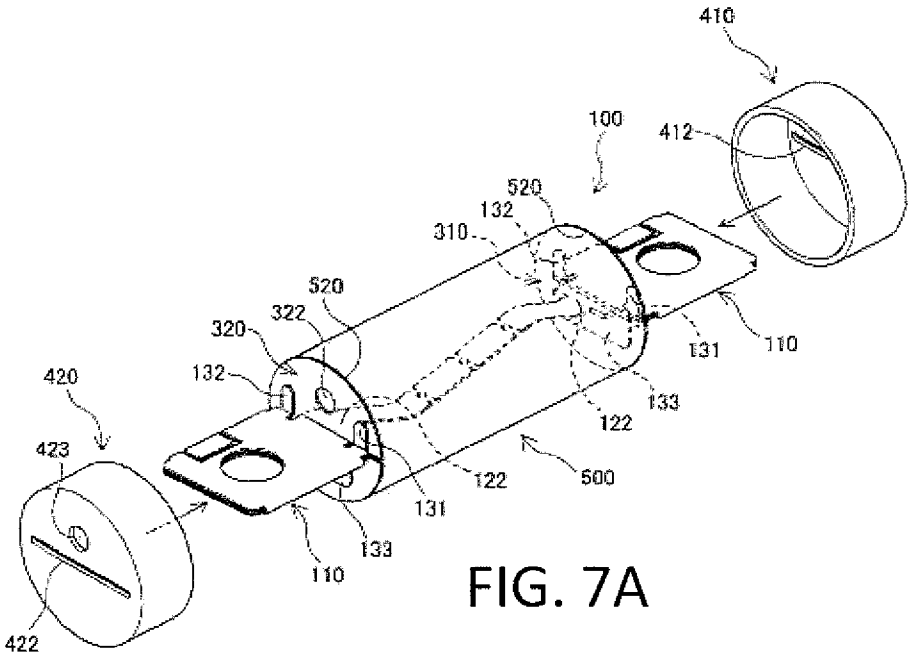
Figure 7B:
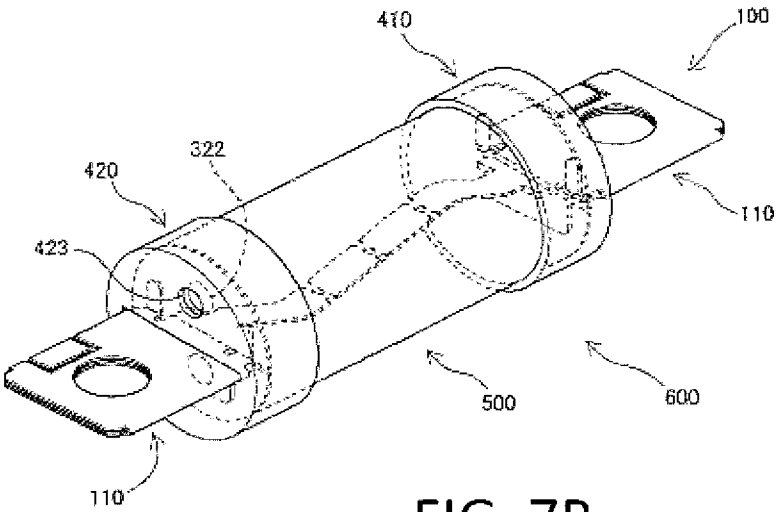

FIGS. 7(*a*) and 7(*b*) are perspective views showing the fuse manufacturing method according to Embodiment 1 of the present invention.

Figure 8A:
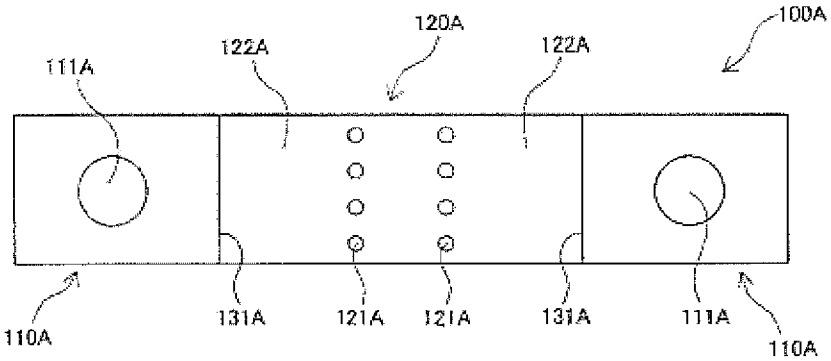
Figure 8B:
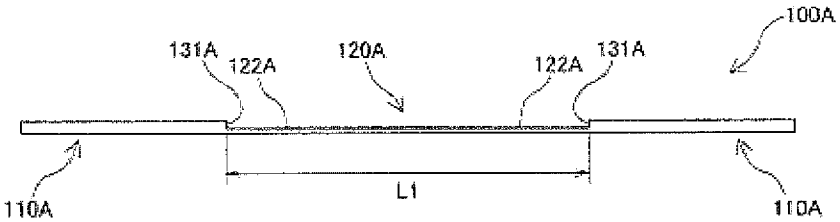
Figure 8C:
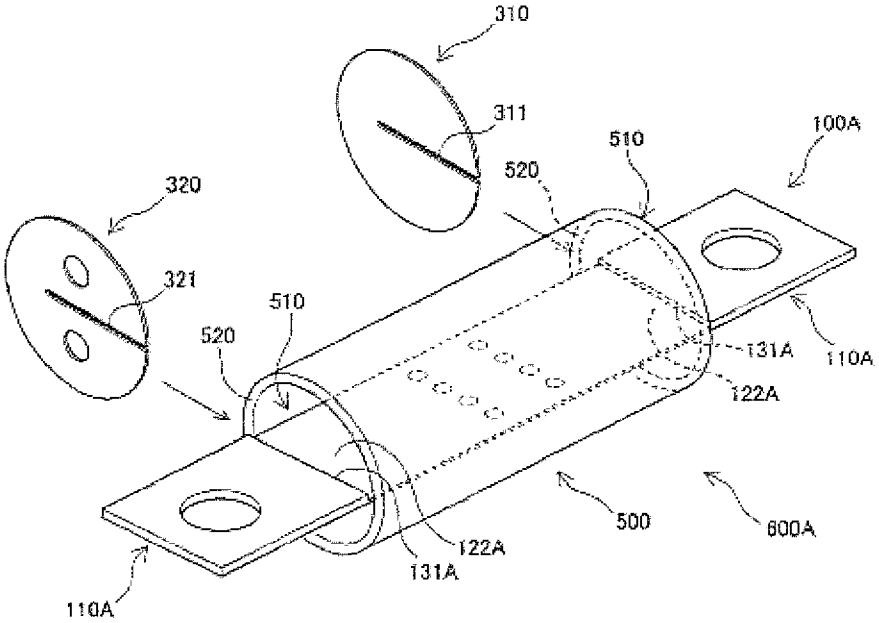

FIG. 8(*a*) is a plan view of a fuse element of a fuse according to Embodiment 2 of the present invention, FIG. 8(*b*) is a front view of the fuse element, and FIG. 8(*c*) is a perspective view showing a method of manufacturing the fuse.

DETAILED DESCRIPTION

Hereinafter, embodiments of the present invention will be described with reference to the drawings. The embodiments to be described below exemplify shapes and materials of respective members included in a fuse and will not be limited to the exemplified shapes and materials. In this specification, the "vertical direction" is a direction perpendicular to a longitudinal direction of a fuse element.

Embodiment 1

FIGS. 1(*a*) to 1(*c*) show a fuse element 100 which is a component constituting a fuse according to Embodiment 1 of the present invention. The fuse element 100 is formed from a thin plate-like metal plate and includes a pair of terminal portions 110 and a fusing portion 120 located between the terminal portions 110. Both ends of the fusing portion 120 are connected to the terminal portions 110 by connecting portions 122. The terminal portion 110 includes a connection hole 111 penetrating in the vertical direction, abutment pieces 131 and 132 rising upwardly at a substantially right angle from a front surface of the terminal portion 110, and an abutment piece 133 rising downwardly at a substantially right angle from a back surface of the terminal portion 110.

The fusing portion 120 is formed by forming a plurality of small holes 121 in a portion of the fuse element 100 having a narrowed width and, when an unintended overcurrent flows through an electric circuit or the like, the fusing portion 120 generates heat and fuses, thereby cutting off the overcurrent. The abutment pieces 131 facing each other are separated by a length L1. Likewise, the abutment pieces 132 facing each other are separated by the length L1, and the abutment pieces 133 facing each other are also separated by the length L1.

Next, referring to FIGS. 2(*a*) to 2(*d*), a method for integrally forming the fuse element 100 will be described. First, a flat plate-like member formed of a conductive metal such as copper or its alloy and having a uniform thickness is punched out with a press machine or the like into a shape as shown in FIG. 2(*a*). An upper end 112, an intermediate end 113, and a lower end 114 are formed at an end of the metal plate shaped into a predetermined shape as shown in the drawing. Creases X are provided at respective boundaries between the upper end 112, the intermediate end 113 and the lower end 114. The upper end 112 and the fusing portion 120 are connected by the flat connecting portion 122.

The upper end 112, the intermediate end 113, and the lower end 114 each have the connection hole 111, and as described later, when the respective ends are folded and superimposed, the connection holes 111 coincide with each other. Further, the upper end 112 is provided with the abutment pieces 131 and 132, and a locking hole 115 vertically penetrating is provided near the boundary with the intermediate end 113. Further, a locking claw 116 is provided at a side end of the lower end 114.

Next, as shown in FIG. 2(*b*), the abutment pieces 131 and 132 of the upper end 112 are folded upward at a substantially right angle. The abutment piece 133 of the lower end 114 is also folded upward at a substantially right angle. The intermediate end 113 is folded back toward a back surface of the upper end 112 at the crease X. In this way, the state shown in FIG. 2(*c*) is obtained. As shown in FIG. 2(*c*), the intermediate end 113 is folded to be superimposed on the back surface of the upper end 112, and a back surface side of the intermediate end 113 appears in the locking hole 115 of the upper end 112.

Then, as shown in FIG. 2(*d*), the lower end 114 is folded back toward the intermediate end 113 at the crease X. In this way, as shown in FIGS. 3(*a*) and 3(*b*), the lower end 114 is folded to be superimposed on the intermediate end 113. Further, the locking claw 116 of the lower end 114 protrudes to a side of the locking hole 115 of the upper end 112. Then, as shown in FIG. 3(*b*), the locking claw 116 is folded back toward the locking hole 115 so as to be superimposed on the back surface of the intermediate end 113 appearing in the locking hole 115.

Thus, the fuse element 100 as shown in FIG. 3(*c*) is completed. As described above, the terminal portion 110 is formed by folding and superimposing the upper end 112, the intermediate end 113, and the lower end 114, which are the ends of the single metal plate. Since the locking claw 116 is engaged with the locking hole 115, it is possible to firmly maintain the state where the upper end 112, the intermediate end 113, and the lower end 114 are folded and superimposed. The abutment pieces 131, 132, and 133 are formed by being folded so as to rise from the terminal portion 110 at a substantially right angle.

Next, holding plates 310 and 320, which are components constituting the fuse according to Embodiment 1 of the present invention, will be described with reference to FIGS. 4(*a*) and 4(*b*). First, as shown in FIG. 4(*a*), the holding plate 310 is a thin plate member having a circular shape with an outer diameter R1 and formed of a conductive metal such as copper or its alloy, and an elongated hole 311 (slit) linearly extending is formed at the center of the holding plate 310. Since an opening width of the elongated hole 311 is equal to or greater than the thickness of the connecting portion 122 of the fuse element 100, and a front end of the elongated hole 311 faces a peripheral portion of the holding plate 310; therefore, the elongated hole 311 can be fitted with the connecting portion 122 from the front end of the elongated hole 311.

Next, the holding plate 320 shown in FIG. 4(*b*) has the same configuration as the holding plate 310, except that a through hole 322 is formed. Specifically, the holding plate 320 has two through holes 322 on both sides of the elongated hole 321. The through hole 322 is used for insertion of an arc-extinguishing agent or the like into the casing, as described later.

Next, caps 410 and 420, which are components constituting the fuse according to Embodiment 1 of the present invention, will be described with reference to FIGS. 4(*c*) and 4(*d*). First, as shown in FIG. 4(*c*), an inside of the cap 410 has a hollow cylindrical shape, and its inner diameter is equal to or greater than the outer diameter R1 of the holding plate (the holding plate 310 and the holding plate 320) and equal to or greater than an outer diameter R3 of the casing (see FIG. 5(*a*)). Thus, the cap 410 can close an opening of the casing so as to cover from the outside in a state where the holding plate (the holding plate 310 and the holding plate 320) is abutted against the opening (see FIGS. 7(*a*) and 7(*b*)). A linear elongated hole 412 is provided in the center of an end surface 411 of the cap 410. The elongated hole 412 has such a size that the terminal portion 110 of the fuse element 100 can be inserted therethrough. The cap 410 can be formed of various materials such as metals and resins.

Next, the cap 420 shown in FIG. 4(*d*) has the same configuration as the cap 410, except that a through hole 423 is formed. More specifically, the cap 420 has the through hole 423 at a position corresponding to the through hole 322 of the holding plate 320. When the cap 420 is fitted into the opening of the casing, since the through hole 423 and the through hole 322 coincide with each other, an arc-extinguishing agent or the like can be inserted into the casing from the through hole 423 side through the through hole 322.

Next, a casing 500, which is a component constituting the fuse according to Embodiment 1 of the present invention, will be described with reference to FIGS. 5(*a*) and 5(*b*). The casing 500 has a tubular shape having openings 510 at its both ends. An inner diameter of a peripheral portion 520 of the opening 510 is R2, an outer diameter of the peripheral portion 520 is R3 (outer diameter R3>inner diameter R2), and a total length of the casing 500 is L2. The peripheral portion 520 is annular in side view. The casing 500 can be formed of various materials such as ceramic and synthetic resin.

Hereinafter, a method (manufacturing method) of assembling the fuse according to Embodiment 1 of the present invention will be described with reference to FIGS. 6(*a*) to 7(*b*).

First, as shown in FIG. 6(*a*), the fuse element 100 is inserted into the casing 500 through any one of the openings 510 of the casing 500, and a position of the fuse element 100 is adjusted such that the terminal portion 110 of the fuse element 100 protrudes from the opening 510 of the casing 500.

Then, as shown in FIGS. 6(*b*) and 6(*c*), the front end of the elongated hole 311 of the holding plate 310 is fitted with one of the connecting portions 122 of the fuse element 100 (the connecting portion 122 on the depth side in the drawing) from the side of the fuse element 100. Similarly, the front end of the elongated hole 321 of the holding plate 320 is fitted with the other connecting portion 122 of the fuse element 100 (the connecting portion 122 on the near side in the drawing) from the side of the fuse element 100. At this time, as shown in FIG. 6(*c*), since the length L1 between the abutment pieces (the abutment pieces 131, 132 and 133) facing each other is longer than the length L2 of the casing 500, a gap is formed between the peripheral portion 520 and the abutment pieces (the abutment pieces 131, 132 and 133) at the opening 510 on each side. The thickness of each of the holding plates 310 and 320 is equal to or less than a size of this gap. Accordingly, the holding plates 310 and 320 can be respectively inserted in the gaps formed on the both sides.

When the connecting portion 122 is inserted to the rear end of the elongated hole 311 of the holding plate 310 and the connecting portion 122 is similarly inserted to the rear end of the elongated hole 321 of the holding plate 320, the state shown in FIG. 7(*a*) is obtained. As shown in FIG. 7(*a*), since the outer diameters R1 of the holding plates 310 and 320 are larger than the inner diameter R2 of the peripheral portion 520 of the casing 500, the holding plates 310 and 320 can close the openings 510 while abutting against the peripheral portions 520 of the openings 510.

The connecting portions 122 of the fuse element 100 are inserted into the elongated holes 311 and 321, and the connecting portions 122 and the elongated holes 311 and 321 are engaged with each other, so that the holding plates 310 and 320 are in a state of being assembled on both end sides of the fuse element 100. While the back surface side of each of the holding plates 310 and 320 is in contact with the peripheral portion 520 of the casing 500, the front side is in contact with the abutment pieces (the abutment pieces 131, 132, and 133) of the opening 510. Thus, the holding plates 310 and 320 are attached to both ends of the casing 500 so as to be sandwiched between the peripheral portion 520 and the abutment pieces and not to move in the longitudinal direction of the casing 500 (the longitudinal direction of the fuse element 100).

Accordingly, the fuse element 100 supported on both sides by the holding plates 310 and 320 is held in the casing 500 so as not to deviate in the longitudinal direction. Consequently, the fuse element 100 can not fall out of the casing 500 or move within the casing 500 during future assembling works, so that workability of assembling the fuse is improved.

Thereafter, as shown in FIG. 7(*a*), the cap 410 is fitted to one end (on the depth side in the drawing) of the casing 500 to close the opening 510. Similarly, the cap 420 is fitted to the other end (on the near side in the drawing) of the casing 500 to close the opening 510. Consequently, the assembling work is completed, and as shown in FIG. 7(*b*), a fuse 600 is completed.

Since the cap 410 is attached so as to cover the holding plate 310, the holding plate 310 is not deviated or fallen out to the outside. The terminal portion 110 of the fuse element 100 protrudes to the outside from the elongated hole 412 of the cap 410. Similarly, since the cap 420 is attached so as to cover the holding plate 320, the holding plate 320 is not deviated or fallen out to the outside. The terminal portion 110 of the fuse element 100 protrudes to the outside from the elongated hole 422 of the cap 420. Even when the cap 420 is attached, as shown in FIG. 7(*b*), since the through hole 423 of the cap 420 and the through hole 322 of the holding plate 320 are overlapped with each other, an arc-extinguishing agent or the like can be appropriately inserted into the casing 500 through the through hole 423 of the cap 420, and then the through hole 423 can be blocked and sealed by any method.

As described above, according to the assembly method (manufacturing method) of the fuse 600 of the present invention and the fuse 600 of the present invention, the holding plate (the holding plate 310 and the holding plate 320) is used in order to hold the fuse element 100 inside the casing 500; however, since the holding plate is configured to be inserted between the abutment piece of the fuse element 100 and the peripheral portion 520 of the casing 500, the number of components is small as compared with the prior art, so that the assembling work is facilitated.

Specifically, in the prior art, in order to hold a fuse element inside a casing, an end of the fuse element is sandwiched between two fusible body holders from above and below the fuse element, so that two fusible body holders are necessary per side of a fuse, and, at the same time, a troublesome work of positioning the fusible body holders from each other and sandwiching the end of the fuse element from above and below is necessary. However, in the present invention, since only one holding plate may be prepared per side of the fuse, the number of parts is reduced, and furthermore it is sufficient to insert the holding plate into the gap between the abutment piece and the peripheral portion, so that work becomes simple.

Further, according to the assembly method (manufacturing method) of the fuse 600 of the present invention and the fuse 600 of the present invention, the terminal portion 110 of the fuse element 100 is formed by folding and superimposing the portions (the upper end 112, the intermediate end 113, and the lower end 114) of the single metal plate, even if the terminal portion 110 has the same thickness as a conventional terminal portion, a resistance value of the terminal portion 110 is small as compared with the prior art.

Specifically, first, the terminal portion of the fuse may have a certain thickness in order to make it easier to connect a terminal connected to an electric circuit or the like to be protected. In the prior art, the end of the fuse element is sandwiched between the two fusible body holders from above and below the fuse element to form an integral terminal portion, and thus to increase the thickness of the terminal portion. However, since the fusible body holder is a separate body from the fuse element, contact resistance occurs between the fusible body holder and the end of the fuse element. However, in the present invention, since the terminal portion 110 of the fuse element 100 is formed by folding and superimposing the portions (the upper end 112, the intermediate end 113, and the lower end 114) of the single metal plate, even if the thickness is increased, high contact resistance as in the prior art does not occur because the ends are formed of the single metal plate and electrically integrated.

The fusible body holder of the prior art has both the function of increasing the thickness of the terminal portion of the fuse and the function of holding the fuse element inside the casing. However, in the fuse 600 of the present invention, the above-described two functions are divided into different methods, and namely, the functions are achieved by the method of inserting the holding plate and the method in which the terminal portion of the fuse element is formed by folding and superimposing a single metal plate, so that it is possible to reduce the number of parts as well as improve the workability as compared with the prior art and to reduce the resistance value of the terminal portion as compared with the prior art.

According to the assembly method (manufacturing method) of the fuse 600 of the present invention and the fuse 600 of the present invention, since the abutment piece is formed by folding a portion of the terminal portion 110, there is no need to attach a separate abutment piece to the terminal portion 110, and contact resistance due to the attachment of the abutment piece does not occur.

In the above embodiment, although the casing 500 has a cylindrical shape, the shape is not limited thereto. For example, as long as the easing 500 has a shape capable of accommodating the fuse element 100 therein, any shape such as a rectangular column shape can be adopted. Although the casing 500 is integrally formed by using a cylindrical form or the like, the present invention is not limited thereto. For example, a casing is vertically divided into two sections in the longitudinal direction, and the fuse element is sandwiched therebetween from above and below, whereby the fuse element may be accommodated in the casing.

Although the elongated hole 311 of the holding plate 310 has a slit shape formed by notching the holding plate 310 from the peripheral portion toward the center, the present invention is not limited thereto, and any shape may be adopted as long as a portion of the holding plate 310 is in contact with a portion of the fuse element 100 and the holding plate 310 can support the fuse element 100. However, in the case of the slit shape as in the elongated hole 311 of the holding plate 310, the holding plate 310 can be easily fitted with the flat connecting portion 122 of the fuse element 100 from the side while being guided by the slit (elongated hole). The elongated hole 311 and the connecting portion 122 are engaged with each other, and the fuse element 100 is supported without being deviated in the vertical direction.

Although the holding plate 310 has a circular shape, the present invention is not limited thereto, and any shape such as an elliptical shape or a triangular shape can be adopted as long as the holding plate 310 can be inserted between the peripheral portion 520 and the abutment piece and, at the same time, can be in contact with both the peripheral portion 520 and the abutment piece. Alternatively, a holding plate formed into a circular shape by connecting two semicircular members to each other may be used. Even if the opening 510 of the casing 500 cannot be completely closed due to the change in the shape of the holding plate 310, since the opening 510 is covered by the cap 410, the inside of the casing 500 is sealed.

Embodiment 2

Hereinafter, a fuse 600A according to Embodiment 2 of the present invention will be described with reference to FIGS. 8(*a*) to 8(*c*). In the fuse 600A, although a fuse element 100A has a different shape from the fuse element 100 shown in FIGS. 7(*a*) and 7(*b*), the fuse 600A is otherwise the same as the fuse 600, so that the explanation of the common configuration will be omitted.

As shown in FIGS. 8(*a*) and 8(*b*), the fuse element 100A is formed of a single metal plate in which the thickness of both ends is large, and a central portion between the both ends has a shape thinner than the thickness of the both ends. The both ends are terminal portions 110A each having a connection hole 111A, and have the same thickness as the terminal portion 110 of FIGS. 7(*a*) and 7(*b*). A plurality of small holes 121A are drilled in the central portion, and the central portion is a fusing portion 120A which cuts off overcurrent. A boundary between the fusing portion 120A and the terminal portion 110A is a connecting portion 122A, which has the same thickness as the connecting portion 122 of FIGS. 7(*a*) and 7(*b*). There is a step between the connecting portion 122A and the terminal portion 110A, and the step portion is an abutment piece 131A. A distance between the abutment pieces 131A facing each other is the length L1 similarly to the fuse element 100 of FIGS. 7(*a*) and 7(*b*).

As shown in FIG. 8(*c*), the fuse element 100A is inserted into a casing 500 through any one of openings 510 of the casing 500, and a position of the fuse element 100A is adjusted such that the terminal portion 110A of the fuse element 100A protrudes from the opening 510 of the casing 500.

Then, a front end of an elongated hole 311 of a holding plate 310 is fitted with one of the connecting portions 122A of the fuse element 100A (the connecting portion 122A on the depth side in the drawing) from the side of the fuse element 100A. Similarly, a front end of an elongated hole 321 of a holding plate 320 is fitted with the other connecting portion 122A of the fuse element 100A (the connecting portion 122A on the near side in the drawing) from the side of the fuse element 100A. Then, the holding plates 310 and 320 are attached to both ends of the fuse element 100A and inserted between a peripheral portion 520 of the opening 510 and the abutment piece 131A of the fuse element 100A. Thus, the fuse element 100A is held inside the casing 500 so as not to deviate in the longitudinal direction. Thereafter, similarly to the case shown in FIGS. 7(*a*) and 7(*b*), caps 410 and 420 are fitted to the respective ends of the casing 500 to close the opening 510, thereby completing the fuse 600A.

According to the assembly method (manufacturing method) of the fuse 600A of the present invention and the fuse 600A of the present invention, which are shown in FIGS. 8(*a*) to 8(*c*), the holding plate (the holding plate 310 and the holding plate 320) is used in order to hold the fuse element 100A inside the casing 500; however, since the holding plate is configured to be inserted between the abutment piece 131A of the fuse element 100A and the peripheral portion 520 of the opening 510 of the casing 500, the number of components is small as compared with the prior art, so that the assembling work is facilitated.

In this specification, although a plurality of small holes are provided at the center of the fuse element to form the fusing portion, the present invention is not limited thereto. For example, the fusing portion may be formed such that the thickness of the central portion of the element is reduced, or the fusing portion may be formed by depositing a low melting point metal containing tin, lead, silver, nickel, an alloy thereof, or the like on a narrow portion of the element.

Further, the fuse and the fuse manufacturing method of the present invention are not limited to the above-mentioned embodiments, and various modifications and combinations can be performed within a range of claims and within a range of the embodiments. These modifications and combinations are also included in the range of rights.

REFERENCE SIGNS LIST

100 Fuse element
110 Terminal portion
120 Fusing portion
131 Abutment piece
132 Abutment piece
133 Abutment piece
310 Holding plate
320 Holding plate
410 Cap
420 Cap
500 Casing
510 Opening
520 Peripheral portion
600 Fuse

The invention claimed is:

1. A method of manufacturing a fuse, the fuse comprising:

a fuse element comprising a pair of terminal portions and a fusing portion between the terminal portions;

a casing for accommodating the fuse element; and a cap for closing openings at both ends of the casing, wherein the fuse element is integrally formed by processing a single metal plate, the terminal portions of the fuse element comprise an upper end, an intermediate end, and a lower end provided on the single metal plate and are formed by folding and superimposing the upper end, the intermediate end and the lower end onto one another, and an abutment piece positioned on the upper end and an abutment piece positioned on the lower end that are folded such that portions of each abutment piece rise from the terminal portions, the fuse manufacturing method comprising:

positioning the fuse element in the casing such that the terminal portions of the fuse element protrudes from the opening of the casing;

inserting a holding plate for holding the fuse element between a peripheral portion of the opening of the casing and the abutment piece provided at each of the upper end and lower end of the terminal portions of the fuse element so as to contact directly with the peripheral portion and each of the abutment pieces on the upper end and lower end of the terminal portions; wherein the holding plate is a single plate member and is provided with an elongated hole linearly extending from the peripheral portion to a center of the holding plate;

wherein the holding plate is inserted between the peripheral portion and each of the abutment pieces on the upper end and lower end of the terminal portions through the elongated hole; and closing the opening of the casing with the cap so as to cover the holding plate.

2. A fuse comprising:

a fuse element comprising a pair of terminal portions and a fusing portion between the terminal portions;

a casing for accommodating the fuse element; and a cap for closing openings at both ends of the casing, wherein the fuse element is formed of a single metal plate, the terminal portions of the fuse element comprise an upper end, an intermediate end and a lower end provided on the single metal plate and are formed by folding and superimposing the upper end, the intermediate end and the lower end onto one another, and the abutment piece positioned on the upper end and an abutment piece positioned on the lower end that are folded such that portions of each abutment piece rise from the terminal portions, the fuse element is positioned in the casing such that the terminal portions of the fuse element protrudes from the opening of the casing, a holding plate for holding the fuse element is inserted between a peripheral portion of the opening of the casing and the abutment piece provided at each of the upper end and lower end of the terminal portions of the fuse element so as to contact directly with the peripheral portion and each of the abutment pieces on the upper end and lower end of the terminal portions wherein the holding plate is a single plate member and is provided with an elongated hole linearly extending from the peripheral portion to a center of the holding plate;

wherein the holding plate is inserted between the peripheral portion and each of the abutment pieces on the upper end and lower end of the terminal portions through the elongated hole;

and the cap closes the opening of the casing so as to cover the holding plate.

* * * * *